US011217377B2

(12) United States Patent
Rylko et al.

(10) Patent No.: US 11,217,377 B2
(45) Date of Patent: Jan. 4, 2022

(54) LOW INTER-WINDING CAPACITANCE COIL FORM

(71) Applicant: SMA Solar Technology AG, Niestetal (DE)

(72) Inventors: Marek Rylko, Bielsko-Biala (PL); Marcin Kacki, Zegocina (PL); Mariusz Walczak, Cracow (PL); Hendrik Oldenkamp, The Hague (NL)

(73) Assignee: SMA Solar Technology AG, Niestetal (DE)

( * ) Notice: Subject to any disclaimer, the term of this patent is extended or adjusted under 35 U.S.C. 154(b) by 1252 days.

(21) Appl. No.: 15/590,334

(22) Filed: May 9, 2017

(65) Prior Publication Data

US 2017/0243687 A1 Aug. 24, 2017

Related U.S. Application Data

(63) Continuation of application No. PCT/EP2015/073760, filed on Oct. 14, 2015.

(30) Foreign Application Priority Data

Nov. 10, 2014 (EP) ..... 14192569

(51) Int. Cl.
*H01F 27/32* (2006.01)
*H01F 21/12* (2006.01)
(Continued)

(52) U.S. Cl.
CPC ..... *H01F 21/12* (2013.01); *H01F 5/02* (2013.01); *H01F 21/005* (2013.01);
(Continued)

(58) Field of Classification Search
CPC .... H01F 21/12; H01F 27/2823; H01F 27/325; H01F 21/005; H01F 5/02; H01F 27/29;
(Continued)

(56) References Cited

U.S. PATENT DOCUMENTS 3,843,903 A 10/1974 Miyoshi et al.
4,234,865 A 11/1980 Shigehara
(Continued)

FOREIGN PATENT DOCUMENTS

CN 102436914 A 5/2012
EP 0666579 A1 8/1995
(Continued)

OTHER PUBLICATIONS

International Search Report and the Written Opinion of the International Searching Authority dated Feb. 1, 2016 for PCT/EP2015/073760.
(Continued)

*Primary Examiner* — Tuyen T Nguyen
(74) *Attorney, Agent, or Firm* — Eschweiler & Potashnik, LLC

(57) ABSTRACT

A coil form with a low inter-winding capacitance is disclosed including a bobbin formed from an electrically insulating material and including a tube section shaped wall. A coil is mechanically supported by the bobbin and includes a first plurality of conductor windings on the outside of the wall and a second plurality of conductor windings on the inside of the wall. Furthermore, a transformer with such a coil form as any of its primary or secondary windings is disclosed.

15 Claims, 2 Drawing Sheets

(51) Int. Cl.

| | |
|---|---|
| ***H01F 5/02*** | (2006.01) |
| ***H01F 27/28*** | (2006.01) |
| ***H01F 21/00*** | (2006.01) |
| *H01F 27/29* | (2006.01) |
| *H01F 5/00* | (2006.01) |

(52) U.S. Cl.
CPC ..... *H01F 27/2823* (2013.01); *H01F 27/325* (2013.01); *H01F 27/29* (2013.01); *H01F 2005/006* (2013.01); *H01F 2005/022* (2013.01)

(58) Field of Classification Search
CPC ..... H01F 2005/006; H01F 2005/022; H01F 27/006; H01F 27/306
See application file for complete search history.

(56) References Cited

U.S. PATENT DOCUMENTS

| | | | | |
|---|---|---|---|---|
| 4,454,492 | A | 6/1984 | Thackray | |
| 4,510,478 | A | 4/1985 | Finkbeiner | |
| 4,714,909 | A | 12/1987 | Dugas | |
| 4,967,121 | A | 10/1990 | Nero | |
| 5,559,486 | A | 9/1996 | Ikenoue et al. | |
| 5,673,013 | A * | 9/1997 | Moody | H01F 5/02 336/192 |
| 5,977,855 | A * | 11/1999 | Matsumura | H01F 27/022 336/96 |
| 7,271,691 | B2 | 9/2007 | Gu et al. | |
| 8,058,962 | B2 * | 11/2011 | Zeng | H01F 27/325 336/208 |
| 2002/0175798 | A1 | 11/2002 | Sigl | |
| 2009/0066290 | A1 | 3/2009 | Altekruse et al. | |
| 2009/0237195 | A1 | 9/2009 | Zeng et al. | |
| 2009/0261934 | A1 | 10/2009 | Wolfgram | |
| 2010/0231342 | A1 | 9/2010 | Zeng et al. | |
| 2010/0231343 | A1 | 9/2010 | Zeng et al. | |

FOREIGN PATENT DOCUMENTS

| | | |
|---|---|---|
| JP | 54116634 | 9/1979 |
| JP | 1989130515 U1 | 9/1989 |
| WO | 2008025683 | 3/2008 |

OTHER PUBLICATIONS

Nair, B. Somanathan. "Electronic Devices and Applications." PHI Learning Pvt. Ltd., 2006. ISBN-81203-2085-9.

* cited by examiner

LOW INTER-WINDING CAPACITANCE COIL FORM

CROSS REFERENCE TO RELATED APPLICATIONS

This application claims priority to International Patent Application number PCT/EP2015/073760, filed on Oct. 14, 2015, which claims priority to European Patent Application number 14192569.3, filed on Nov. 10, 2014, and is hereby incorporated by reference in its entirety.

FIELD

The present disclosure relates to a coil form. Particularly, the present disclosure relates to a coil form displaying a low inter-winding capacitance. Whereas the coil form may be used in various appliances, including inductors, the coil form may find use, for example, in transformers.

BACKGROUND

In a coil form, the inter-winding capacitance is due to the fact that a voltage dropping over the coil of the coil form results in voltages present between neighboring individual conductor windings of the coil. The electrical insulation between these conductor windings acts as a dielectric forming some kind of a capacitor whose electrodes are the neighboring conductor windings and which is loaded by the voltage present between neighboring conductor windings. Thus, the relevance of the inter-winding capacitance is increasing with increasing voltage present between neighboring conductor windings.

There are several known winding layouts for a coil form which have the purpose of reducing the voltage present between neighboring individual windings. See, for example, U.S. Pat. No. 4,454,492 A and U.S. Pat. No. 7,271,691 B2.

Further, it is known to provide a bobbin on which the conductor windings of a coil form are wound with partitioning walls. A coil formed on such a bobbin comprises several pluralities of conductor windings separated from each other by the partitioning walls. The maximum voltage present between neighboring windings within each plurality of conductor windings is limited to 1/n with n pluralities of conductor windings as compared to a bobbin without partitioning walls. A transformer comprising bobbins with partitioning walls for both coil forms providing its primary and secondary windings is, for example, disclosed in U.S. Pat. No. 3,843,903 A1.

B. Somanathan Nair: "Electronic Devices and Applications", PHI Learning Pvt. Ltd., 2006, describes a so-called spaced-layer winding as a means for reducing the inter-winding capacitance in which each layer of conductor windings on a bobbin is covered with a spacer before the next layer of conductor windings is applied.

In addition to the inter-winding capacitance, the electrical winding resistance of the coil is highly relevant in most applications of coil forms, particularly with high frequency devices. Typically, the winding resistance should be as low as possible. One problem particularly with high frequency devices are winding terminations that jeopardize the performance of the coil form by an increased power loss due to an increased contact resistance. In general, every termination and solder joint between conductor sections will significantly increase the winding resistance.

Another relevant aspect with coil forms is symmetry. Only a perfectly symmetrical winding layout of a coil form will provide uniform and balanced magnetic field distribution that narrows the leakage inductance spread and reduces the electromagnetic interference (EMI).

In known symmetrical winding layouts for coil forms, the conductor windings of one coil are wound from two conductor sections on the opposite sides of a partitioning wall in the middle of a bobbin. The conductor windings of the two conductor sections start at the far ends of the bobbin, and they are connected in the middle of the bobbin. Thus, there is an additional solder joint within the coil in addition to the solder joints connecting the coil to connection leads.

A high voltage transformer for a video apparatus providing electrical isolation between the primary and secondary windings is known from U.S. Pat. No. 4,967,121 A. The primary winding is wound on a first bobbin, while the secondary winding is wound on a second separate bobbin that surrounds the first bobbin with the bobbin structure providing a physical isolation barrier. A high voltage or tertiary winding is wound on a high voltage bobbin which fits over the primary and secondary bobbin structure.

US 2009/0066290 A1 discloses a battery charger with a high-frequency transformer. The high-frequency transformer has a bobbin providing a first coil winding surface having a central axis. A first coil is wound around the first coil winding surface. A second coil is magnetically coupled to the first coil and wound thereto. There may also be a third coil. An insulating shroud is located over the first coil, and the second and third coils are wound around the insulating shroud with the second coil wound over the top of the third coil.

U.S. Pat. No. 5,559,486 A, WO 2008/025683 A1, U.S. Pat. No. 4,510,478 A, U.S. Pat. No. 4,234,856 A, EP 0 666 579 A1, US 2002/0175798 A1 and US 2009/0261934 A1 disclose further coil forms for transformers with primary and secondary windings, each of the primary and secondary windings being mechanically supported by a bobbin.

SUMMARY

The present disclosure provides a coil form of particularly low inter-winding capacitance which is suited for a symmetrical winding layout without additional solder joints between separate conductor sections.

According to the present disclosure, a coil form comprises a bobbin made of an electrically insulating material and including a tube section shaped wall. The coil form further comprises a coil mechanically supported by the bobbin and including a first plurality of conductor windings on the outside of the wall and a second plurality of conductor windings on the inside of the wall.

The tube section shaped wall may be of various cross-sections including circular, oval, ellipsoid and rectangular cross-sections with or without rounded edges. The bobbin of the coil form supports the coil of the coil form. This coil includes the first plurality of conductor windings on the outside of the wall and the second plurality of conductor windings on the inside of the wall so that the first and the second pluralities of conductor windings are separated by the wall made of electrically insulating material. Thus, the coil of the coil form according to the present disclosure is partitioned evenly without any partitioning wall extending from the outside of the wall of the bobbin. Instead, the wall inherently included in most bobbins provides the partitioning.

In the coil form according to the present disclosure, the wall of the bobbin separating the first plurality of conductor windings from the second plurality of conductor windings is not just an insulating layer, but indeed that wall supports the first plurality of conductor windings on the outside of the wall and also supports the second plurality of conductor windings on the inside of the wall. For this purpose of supporting the second plurality of conductor windings by the wall, the conductor may be in some way fixed to the inside of the wall, in one embodiment. However, with a solid wire as the conductor the internal elasticity of the wound wire and its back-springing after being wound will often be sufficient for force fitting the second plurality of windings to the inside of the wall.

In one embodiment of the coil form, the first plurality of conductor windings and the second plurality of conductor windings are formed from a single continuous conductor section. The single continuous conductor section passes the wall at one end of two ends of the bobbin. In this case a port can be provided at one end of the two ends of the bobbin at which the continuous conductor section passes the wall in order to enable and simplify the passing. Alternatively, the single continuous conductor section can also pass the wall at a section distant to one end of the two ends of the bobbin. In this case, a notch or a hole for passing through of the continuous conductor section can be provided in the wall. The notch starts at one end of the two ends of the bobbin, directs along the length of the bobbin to a middle section of the bobbin and may extend away from the one end of the two ends of the bobbin up to a specified distance. Thus, there is no solder joint between the first and the second plurality of conductor windings that would otherwise increase the electrical winding resistance of the coil. For example, the second plurality of conductor windings may first be wound on an auxiliary bobbin. Then, the bobbin may be placed on top of the second plurality of conductor windings enclosing the auxiliary bobbin. Afterwards, the first plurality of conductor windings may be wound on the outside of the wall of the bobbin. At any time after placing the bobbin on top of the second plurality of conductor windings, a winding force may be released so that the elasticity of the conductor force fits the second plurality of conductor windings to the inside of the wall of the bobbin. Afterwards, the auxiliary bobbin may easily be removed.

To provide for a symmetric winding layout, a third plurality of conductor windings may, in addition to the first plurality of conductor windings, be provided on the outside of the wall of the bobbin, the first, second and third pluralities of conductor windings being formed from the single continuous conductor section. In one embodiment, the single continuous conductor section passes the wall at one or both ends of the bobbin. In the latter case, a symmetrical winding layout is achieved without any soldering joint within the coil.

The first plurality of conductor windings and the third plurality of conductor windings may be separated by a flange of the bobbin radially extending from the outside of the wall. This flange will suitably be arranged in the middle along the length of the bobbin. It is not a partitioning wall as it does not partition the coil into partial coils, but electrically insulates the first and the last windings of the coil from each other.

Connection leads for electrically connecting both ends of the coil may be connected to the ends of the first and third plurality of windings on opposite sides of the flange of the bobbin. These connection leads may be arranged at a distance in circumferential direction around the bobbin even if pointing away from the bobbin in a same direction.

The connection leads may extend through separate channels of an insulating housing mechanically connected to the bobbin and providing for a sufficient electrical insulation between the connection leads between which the full voltage applied to the coil or induced in the coil is present. Generally, any insulating housing for the connection leads may be used that provides adequate insulation.

In the coil form according to the present disclosure, the bobbin may comprise an end flange radially extending from the outside of the wall at one of its ends. This end flange may comprise the port through which the conductor passes when passing the wall at this end of the bobbin. The end flange not only holds or secures the adjacent first or third plurality of conductor windings on the outside of the wall, it also fixes the second plurality of conductor windings by means of the conductor passing the flange. Such end flanges may be provided at both ends of the wall, fixing the second plurality of conductor windings by the conductor passing the end flanges at both ends of the second plurality of conductor windings. In addition to the end flanges, ports or notches may be provided at both ends of the bobbin to enable and/or simplify the passing of the continuous conductor section through the wall. It goes without saying, that any feature stated before with regard to a single port or a single notch may also be applied to the ports or notches at both ends of the bobbin.

In the coil form according to the present disclosure, the conductor windings of each plurality of conductor windings may be arranged in several layers. A minimum inter-winding capacitance, however, is achieved if each plurality of conductor windings only comprises one layer of conductor windings on the respective inside or outside of the wall. In case of the second plurality of conductor windings arranged on the inside of the wall, only one layer of windings may also help in fixing the second plurality of windings on the inside of the wall by the elasticity and back-spring effect of a wound wire forming the conductor. In a coil form according to the present disclosure, in which each of the pluralities of conductor windings only comprises one layer of conductor windings on the respective inside or outside of the wall, each conductor winding is directly supported by the bobbin and not by a previous layer of conductor windings which is the case in a multilayered coil design. Therefore, in the coil form of the present disclosure, the location of each conductor winding within each of the pluralities of conductor windings is defined in an optimum way and not influenced by the location of a previous conductor winding. This leads to an optimized process capability in the manufacture of the coil forms. It also leads to an optimized reproducibility regarding the magnetic properties of individual coil forms comprising a certain coil form design.

A transformer according to the present disclosure comprises the coil form according to the present disclosure as any one of its primary or secondary windings.

The other of the primary or secondary windings of the transformer may comprise a further coil of a plurality of conductor windings wound on the outside of a first tube section shaped wall of a further bobbin made of an electrically insulating material. The further bobbin may further comprise a second tube section shaped wall enclosed by the first tube section shaped wall. This second tube section shaped wall of the further bobbin may be adapted to support the coil form according to the present disclosure within the further coil. Thus, the further bobbin does not only support the further coil but also defines the relative arrangement of the primary and secondary windings of the transformer. In one embodiment, the bobbin and the further bobbin are made of a synthetic resin and are manufactured via an injection molding process. Due to this the geometrical design of the bobbin and the further bobbin can be manufactured extremely accurate, i. e. within extremely low tolerances. This in turn is advantageous for the relative arrangement of the primary and secondary windings of the transformer. In this arrangement, the secondary winding of the transformer may be the inner winding, i.e. provided by the coil form according to the present disclosure.

In the transformer according to the present disclosure, a gap remaining between the coil form according to the present disclosure and the first tube section shaped wall of the further bobbin may be filled with a potting material. This potting material may also enclose the primary and secondary windings of the transformer within a transformer housing, i.e. fix both windings within the transformer housing. Optionally, the potting material may only fill the gap remaining between the coil form according to the present disclosure and the first tube section shaped wall of the further bobbin. In this case it only encloses the secondary (inner) winding but not the primary (outer) winding, if such an enclosure—for whatever reasons—is not needed.

The transformer may particularly be used as a high frequency transformer. Even more particular, it may be used in a resonantly operated DC/DC converter.

Advantageous developments of the disclosure result from the claims, the description and the drawings. The advantages of features and of combinations of a plurality of features mentioned at the beginning of the description only serve as examples and may be used alternatively or cumulatively without the necessity of embodiments according to the disclosure having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the disclosure or of features of different claims independent of the chosen references of the claims is also possible, and it is motivated herewith.

This also relates to features which are illustrated in separate drawings, or which are mentioned when describing them. These features may also be combined with features of different claims. Furthermore, it is possible that further embodiments of the disclosure do not have the features mentioned in the claims.

The number of the features mentioned in the claims and in the description is to be understood to cover this exact number and a greater number than the mentioned number without having to explicitly use the adverb "at least". For example, if a plurality of conductor windings is mentioned, this is to be understood such that there is exactly one plurality of conductor windings or there are two pluralities of conductor windings or more pluralities of conductor windings. Additional features may be added to these features, or these features may be the only features of the respective product.

The reference signs contained in the claims are not limiting the extent of the matter protected by the claims. Their sole function is to make the claims easier to understand.

BRIEF DESCRIPTION OF THE DRAWINGS

In the following, the disclosure is further explained and described with respect to preferred exemplary embodiments illustrated in the drawings.

DETAILED DESCRIPTION

Figure 1:
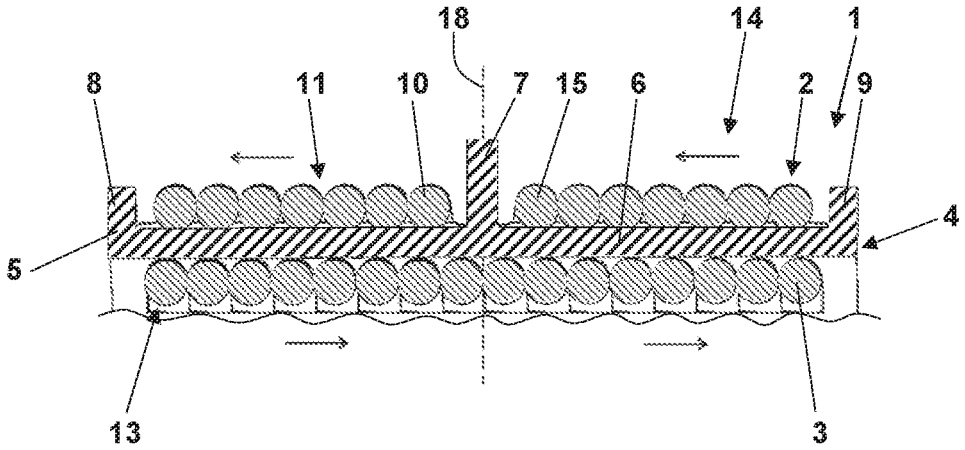
FIG. 1 is a cross-section through a wall of a bobbin and pluralities of windings on the inside and outside of the wall of a coil form according to the present disclosure.
Figure 2:
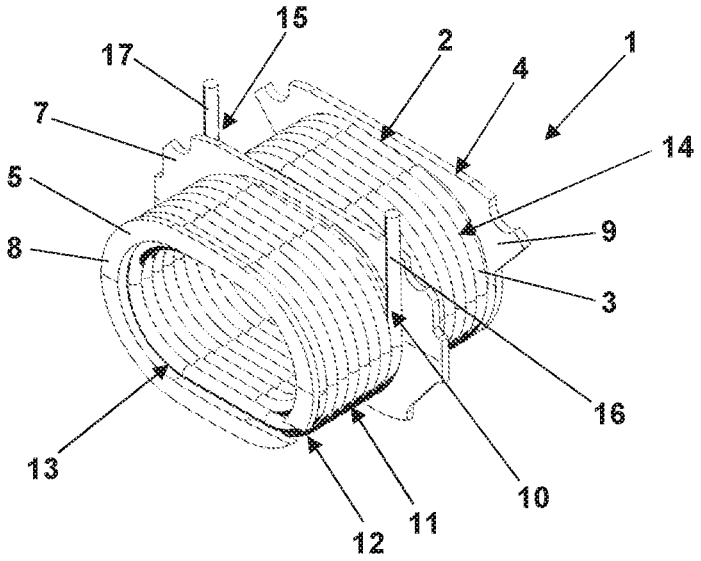
FIG. 2 is a full perspective view of the coil form according to FIG. 1.

In the coil form 1 according to FIGS. 1 and 2 a single continuous conductor section 2 formed from solid wire 3 is wound within and around a bobbin 4 made of electrically insulating material 5. The bobbin 4 comprises a tube section shaped wall 6, a center flange 7 made of the material 5 and radially extending from the outside of the wall 6 and two end flanges 8 and 9 also made of the material 5 and radially extending from the outside of the wall 6. Beginning at a start 10, the continuous conductor section 2 at first forms a first plurality 11 of conductor windings on the outside of the wall 6. Then, the continuous conductor section 2 passes a port 12 in the end flange 8. Next, the continuous conductor section 2 forms a second plurality 13 of conductor windings at the inside of the wall 6. Then, the continuous conductor section 2 passes a port in the end flange 9, before it finally forms a third plurality of conductor windings 14 up to an end 15. Except of connection terminals 16 and 17 at the start 10 and the end 15 of the continuous conductor section 2, the entire winding layout is mirror-symmetric with regard to a symmetry plane 18 extending through the center flange 7. All three pluralities 11, 13 and 14 of conductor windings only comprise one layer of windings. The first, second and third pluralities 11, 13 and 14 of conductor windings are separated from each other by the insulating material 5. Thus, the maximum voltage present between directly adjacent or neighboring conductor windings is reduced to 1/n of the voltage present between the connection terminals 16 and 17 with n conductor windings in the entire coil form 1. Further, the electrical resistance of the coil including all three pluralities 11, 13 and 14 of conductor windings is not affected by any solder joints between the individual pluralities 11, 13 and 14 of conductor windings.

The embodiment of the disclosure illustrated in FIG. 1 and FIG. 2 comprises only one layer of conductor windings within each of the pluralities 11, 13, 14 of conductor windings. In an alternative embodiment, at least one of all pluralities 11, 13, 14 of conductor windings, e.g. the first and the third plurality of conductor windings, comprises more than one layer of conductor windings. In order to still have an optimized symmetry with regard to the symmetry plane 18, the amounts of layers and conductor windings of the first and third pluralities 11, 14 of conductor windings have to be equal then. Another alternative embodiment not shown in in the drawings, only comprises two pluralities of conductor windings, wherein the first plurality 11 is located on the outside of the wall 6 and the second plurality 13 is located at the inside of the wall 6 of the bobbin 4. In this case it is also possible that at least one of the first and second pluralities 11, 13 of conductor windings comprises more than one layer of conductor windings. In that case, the first and second pluralities of conductor windings do not necessarily comprise the same amounts of layers and/or conductor windings. In this particular case it is also possible that the first and second pluralities 11, 13 of conductor windings comprise different amounts of layers and/or conductor windings, wherein the resulting coil form 1 may still provide a sufficiently uniform and balanced magnetic field distribution that narrows the leakage inductance spread and reduces the electromagnetic influence interference (EMI) when used in a transformer.

Figure 3:
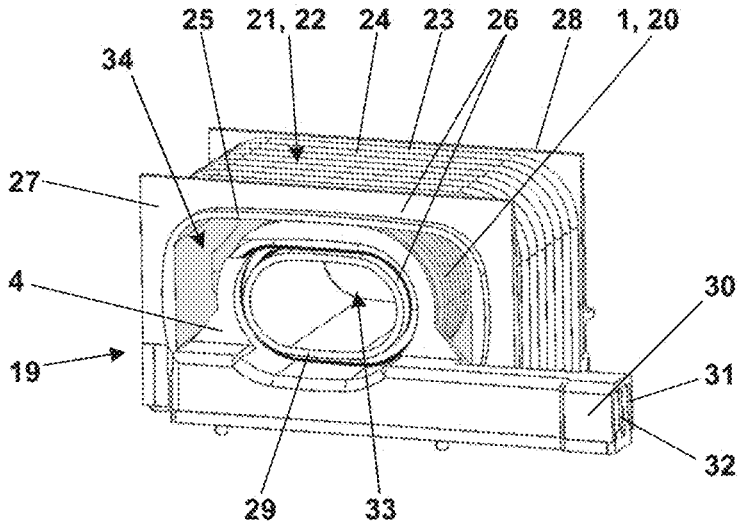
FIG. 3 is a perspective view of a transformer including the coil form according to FIGS. 1 and 2.

In the transformer 19 depicted in FIG. 3, the coil form 1 according to FIGS. 1 and 2 provides a secondary winding 20 arranged within a coil 21, forming the primary winding 22 of the transformer 19. The coil 21 comprises a plurality of windings of a continuous conductor section 23 which is also formed from a solid wire 24, here. The coil 21 comprises a plurality of layers wound around a first tube section shaped wall 25 of a further bobbin 26 extending between end flanges 27 and 28. The further bobbin 26 also comprises a second tube section shaped wall 29 on which the coil form 1 according to FIGS. 1 and 2 is arranged to align it in a defined relative position with regard to the primary winding 22. The connection terminals 16 and 17 are connected by connection leads (not visible here) extending through separate channels 31 and 32 of an insulation housing 30 mechanically connected to the bobbin 4 of the coil form 1.

The second tube section shaped wall 29 of the further bobbin 26, which—like the tube section shaped wall 6 of the bobbin 4—may be of various cross-sections including circular, oval, ellipsoid and rectangular cross-sections with or without rounded edges, defines a through-hole 33. The transformer 19 may comprise a magnetic core—not explicitly depicted in FIG. 3—which extends through a through-hole 33 and which may comprise any known core geometry, e.g. an U-I or an E-E core geometry. Advantageously a cross section of the magnetic core corresponds to the cross section of the through-hole 33 in order to provide a sufficient form fit between the magnetic core and the further bobbin 26 in the assembled status of the transformer 19.

The transformer 19 depicted in FIG. 3 may be arranged in a transformer housing not explicitly illustrated in FIG. 3 for reason of clarity. The transformer housing may be made of metal and may be electrically grounded later on in order to act as an electromagnetic shielding which reduces the electromagnetic radiation generated by the transformer 19. Additionally or alternatively a metal sheet is provided as an electromagnetic shielding covering the outer conductor windings wound on the first tube section shaped wall 25 of the further bobbin 26. The remaining gap between the second tube section shaped wall 29—or rather the coil form 1—and the first tube section shaped wall 25 of the further bobbin 26 may be filled with potting material 34. In order to prevent an outflow of the potting material 34 out of the backside of that gap, the further bobbin 26 comprises a continuous wall section between the second tube section shaped wall 29 and the first tube section shaped wall 25 at one side of the further bobbin 26, e.g. at the side of the end flange 28. This offers the possibility to use that gap as a box for the potting material 34 and provide the potting material 34 only to the secondary (inner) winding 20 but not to the primary (outer) winding 22. This saves material and costs in applications the primary (outer) winding 22 do not require a coverage with potting material 34, e.g. due to its low voltages. Due to the lower amount of potting material 34 and its position within the transformer also thermal stresses applied to the magnetic core of the transformer is eliminated, at least reduced significantly. However it is optionally also possible, that the assembled transformer 19 within the transformer housing is as a whole—or at least at large—embedded in potting material 34 in order to fix the arrangement of the primary winding 22 and the secondary winding 20 as well as the arrangement of the transformer 19 within the transformer housing and to enhance the electrical insulation between the primary and secondary windings 22, 20 and between that windings and the transformer housing. Additionally, the closed continuous wall section between the second tube section shaped wall 29 and the first tube section shaped wall 25 at the one side of the further bobbin 26 ensures an optimized isolation between the magnetic core and the secondary winding 20 at that one side. Due to this isolation the magnetic core can be brought in direct contact with the continuous wall and therefore relatively close to—but electrically isolated from—the secondary winding. This is an advantage with regard to the overall building size of the transformer.

What is claimed is:

1. A coil form, comprising:

a bobbin made of an electrically insulating material and including a tube section shaped wall; and a coil mechanically supported by the bobbin and including a first plurality of conductor windings on an outside of the tube section shaped wall and a second plurality of conductor windings on an inside of the tube section shaped wall, wherein the first plurality of conductor windings and the second plurality of conductor windings are formed from a single continuous conductor section that passes the tube section shaped wall at one end of two ends of the bobbin.

2. The coil form of claim 1, further comprising a third plurality of conductor windings on the outside of the tube section shaped wall, wherein the first plurality of conductor windings, the second plurality of conductor windings and the third plurality of conductor windings are formed from the single continuous conductor section.

3. The coil form of claim 2, wherein the single continuous conductor section passes the tube section shaped wall at both ends of the bobbin.

4. The coil form of claim 2, wherein the first plurality of conductor windings and the third plurality of conductor windings are separated by a flange of the bobbin radially extending from the outside of the tube section shaped wall.

5. The coil form of claim 4, further comprising connection leads for electrically connecting both ends of the coil, wherein the connection leads are connected to the ends of the first and third pluralities of conductor windings on opposite sides of the flange of the bobbin.

6. The coil form of claim 5, wherein the connection leads are extending through separate channels of an insulating housing mechanically connected to the bobbin.

7. The coil form of claim 1, wherein the bobbin comprises an end flange radially extending from the outside of the tube section shaped wall at at least one of its ends, the end flange comprising a port through which the single continuous conductor section passes.

8. The coil form of claim 1, wherein the second plurality of conductor windings comprises one layer of conductor windings on the inside of the tube section shaped wall only.

9. The coil form of claim 1, wherein each plurality of conductor windings on the outside of the tube section shaped wall comprises one layer of conductor windings on the outside of the tube section shaped wall only.

10. A transformer comprising the coil form of claim 1 as any one of its primary or secondary windings.

11. The transformer of claim 10, wherein the other of the primary or secondary windings comprises a further coil of a plurality of conductor windings wound on the outside of a first tube section shaped wall of a further bobbin made of an electrically insulating material, wherein the further bobbin comprises a second tube section shaped wall enclosed by the first tube section shaped wall and supporting the coil form within the further coil.

12. The transformer of claim 11, wherein a gap remaining between the coil form and the first tube section shaped wall of the further bobbin is filled with a potting material.

13. The transformer of claim 12, wherein the potting material encloses the primary and secondary windings within a transformer housing.

14. The transformer of claim 11, wherein the second tube section shaped wall has a circular, oval, ellipsoidal, or rectangular cross-sectional profile.

15. The coil form of claim 4, wherein except for both ends of the single continuous conductor section, a winding layout of the coil form is mirror-symmetric with regard to a symmetry plane extending through the flange.

* * * * *